US012329198B2

(12) United States Patent
Qiu

(10) Patent No.: US 12,329,198 B2
(45) Date of Patent: Jun. 17, 2025

(54) LIQUID INJECTION METHOD OF CARTRIDGE, CARTRIDGE AND ELECTRONIC CIGARETTE

(71) Applicant: CHANGZHOU PATENT ELECTRONIC TECHNOLOGY CO., LTD, Jiangsu (CN)

(72) Inventor: Weihua Qiu, Jiangsu (CN)

(73) Assignee: CHANGZHOU PATENT ELECTRONIC TECHNOLOGY CO., LTD, Jiangsu (CN)

( * ) Notice: Subject to any disclaimer, the term of this patent is extended or adjusted under 35 U.S.C. 154(b) by 701 days.

(21) Appl. No.: 17/450,211

(22) Filed: Oct. 7, 2021

(65) Prior Publication Data

US 2022/0022538 A1 Jan. 27, 2022

Related U.S. Application Data

(63) Continuation-in-part of application No. PCT/CN2020/094066, filed on Jun. 3, 2020.

(30) Foreign Application Priority Data

Jun. 3, 2019 (CN) ..... 201910477168.4

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/51* (2020.01); *A24F 40/85* (2020.01)

(58) Field of Classification Search
None
See application file for complete search history.

(56) References Cited

U.S. PATENT DOCUMENTS

2019/0037926 A1* 2/2019 Qiu ..... A24F 40/46

FOREIGN PATENT DOCUMENTS

CN 208354608 U 1/2019
CN 109619691 A 4/2019
(Continued)

OTHER PUBLICATIONS

CN207428418U, Atomization device and electronic cigarette thereof, (Year: 2018).*

*Primary Examiner* — Michael J Felton
(74) *Attorney, Agent, or Firm* — NKL Law; Allen Xue

(57) ABSTRACT

A cartridge includes a cartridge housing having a liquid storage cavity, and a sealing member for sealing the liquid storage cavity, and a first electrode and a second electrode mounted on the sealing member. A first blind hole and a second blind hole are respectively disposed on the end face of the sealing member away from the liquid storage cavity. The liquid injection needle pierces the sealing member through the wall of at least one of the first blind hole and the second blind hole and communicates with the liquid storage cavity to inject liquid into the liquid storage cavity. After the liquid injection is completed, the liquid injection needle is pulled out, and the sealing member is self-sealed at the pierced position. The first blind hole is blocked by the first electrode while the second blind hole is blocked by the second electrode.

11 Claims, 4 Drawing Sheets

(51) Int. Cl.

| | |
|---|---|
| ***A24F 40/46*** | (2020.01) |
| ***A24F 40/51*** | (2020.01) |
| ***A24F 40/85*** | (2020.01) |

(56) References Cited

FOREIGN PATENT DOCUMENTS

| | | | | | |
|---|---|---|---|---|---|
| CN | 109700075 | A | | 5/2019 | |
| CN | 109717519 | A | | 5/2019 | |
| CN | 208849515 | U | | 5/2019 | |
| CN | 210137810 | U | | 3/2020 | |
| WO | WO-2017139595 | A1 | * | 8/2017 | ..... A24F 40/42 |

* cited by examiner

LIQUID INJECTION METHOD OF CARTRIDGE, CARTRIDGE AND ELECTRONIC CIGARETTE

CROSS-REFERENCE TO RELATED APPLICATIONS

This application is a continuation-in-part of PCT International Patent Application No. PCT/CN2020/094066, filed on Jun. 3, 2020, entitled "liquid injection method of cartridge, cartridge and electronic cigarette", which claims priority to Chinese Patent Application No. 201910477168.4, filed on Jun. 3, 2019. All of the aforementioned patent applications are hereby incorporated by reference in their entireties.

TECHNICAL FIELD

The disclosure relates to the technical field of electronic cigarette, and more particularly, relates to a liquid injection method of cartridge, a cartridge and an electronic cigarette.

BACKGROUND

Electronic cigarettes have become a relatively mature alternative to smoking in the market, it supplies power to the heating member in the atomizing head through the battery, so that the heating member heats the adsorbed e-cigarette liquid (hereinafter, "e-liquid") on the liquid guiding member under the action of electric drive to generate smoke, so that the user can obtain a smoking experience.

Currently on the market, there are usually two types of cartridges for electronic cigarettes. The first type does not include an atomizing head, the second type includes a cartridge with an atomizing head. For the first type of cartridge, the cartridge needs to be assembled with a sealing member for sealing the liquid storage cavity after the e-liquid is filled, and leakage is prone to occur during the process of assembling the sealing member. For the second type of cartridge, this type of electronic cigarette is prone to leakage when the atomizer head is assembled after filling the e-liquid.

SUMMARY

Based on the above, it is necessary to provide a liquid injection method for a cartridge that can prevent the leakage of e-liquid.

It is also necessary to provide a cartridge and electronic cigarette for the liquid injection method.

The technical solutions adopted by the present disclosure to solve its technical problems are: the cartridge includes a cartridge housing having a liquid storage cavity, and a sealing member for sealing the liquid storage cavity, and a first electrode and a second electrode mounted on the sealing member. A first blind hole and a second blind hole are respectively opened on the end face of the sealing member away from the liquid storage cavity. The sealing member is made of elastic material. The liquid injection needle pierces the sealing member through the wall of at least one of the first blind hole and the second blind hole, and communicates with the liquid storage cavity to inject liquid into the liquid storage cavity. After the liquid injection is completed, the liquid injection needle is pulled out, and the sealing member forms a self-sealing at the pierced position; then the first blind hole is blocked by the first electrode, and the second blind hole is blocked by the second electrode.

In one embodiment, the first electrode is at least partially inserted into the first blind hole and the inserted part blocks the first blind hole, the second electrode is at least partially inserted into the second blind hole and the inserted part blocks the second blind hole.

In one embodiment, the cartridge further includes an atomizing head, the atomizing head is housed in the liquid storage cavity, the atomizing head includes heating structure, the heating structure has two pins extending to the outside of the liquid storage cavity. The first electrode squeezes and fixes a part of one of the pins extending to the outside of the liquid storage cavity on the side wall of the first blind hole and is electrically connected to the pin. The second electrode squeezes and fixes the part of the other outer pin protruding to the outside of the liquid storage cavity on the side wall of the second blind hole and is electrically connected to the pin.

In one embodiment, the atomizing head further includes an atomizing tube, the atomizing tube is provided with an atomizing cavity communicating with the liquid storage cavity, the heating structure is contained in the atomizing cavity, the sealing member is provided with a through hole, one end of the atomizing tube is sealed and inserted into the through hole, the two pins of the heating structure extend to the outside of the liquid storage cavity after passing through the through hole.

In one embodiment, the atomizing head also includes a base, the base is located outside the liquid storage cavity and resists the end surface of the sealing member away from the liquid storage cavity, one end of the first electrode passes through the base and is tightly inserted into the first blind hole, one end of the second electrode passes through the base and is tightly inserted into the second blind hole.

In one embodiment, the base is provided with a first mounting groove corresponding to the first blind hole and a second mounting groove corresponding to the second blind hole, one end of the first electrode passes through the bottom wall of the first mounting groove and then is inserted into the first blind hole, the other end of the first electrode is against the bottom wall of the first mounting groove. One end of the second electrode passes through the bottom wall of the second mounting groove and is inserted into the second blind hole, the other end of the second electrode abuts against the bottom wall of the second mounting groove.

In one embodiment, the cartridge has a smoke outlet located at one end of the cartridge housing, the sealing member is located at the other end of the cartridge housing relative to the smoke outlet, the first electrode and the second electrode are symmetrically arranged with respect to the central axis of the cartridge housing.

An electronic cigarette, the electronic cigarette comprising the cartridge described in any one of the foregoing.

In one embodiment, the cartridge further includes a power supply device, the power supply device includes a battery housing and a battery, the battery housing has an opening, and a partition is arranged in the battery housing, the partition divides the inner cavity of the battery housing into a battery mounting groove for installing the battery and a cartridge mounting groove for installing a cigarette cartridge. The battery mounting groove is located at an end of the battery housing away from the opening.

In one embodiment, a first pole and a second pole are respectively installed on the partition, the first pole is electrically connected to one of the positive and negative electrodes of the battery, the second pole is electrically connected to the other of the positive and negative electrodes of the battery. When the cartridge and the power supply device are in the first connection state, the first pole is in contact with the first electrode and is electrically connected; when the cartridge and the power supply device are in the second connection state, the second pole is in contact with the second electrode and is electrically connected, In addition, the present invention also provides a liquid injection method for a cartridge, which is for the cartridge described in any one of the foregoing and the electronic cigarette described in any one of the foregoing, and the liquid injection method includes the following steps:

Step 1: the liquid injection needle pierces the sealing member through the wall of at least one of the first blind hole and the second blind hole, and then communicates with the liquid storage cavity to inject liquid into the liquid storage cavity;

Step 2: after the liquid injection is completed, pull out the liquid injection needle, and the sealing member forms a self-sealing at the pierced position;

Step 3: the first blind hole is blocked by the first electrode, and the second blind hole is blocked by the second electrode.

In one embodiment, an incision is provided on the wall of the second blind hole, during the liquid injection process, the pressure in the liquid storage cavity increases so that the incision is pushed open, the air in the liquid storage cavity is discharged from the cutout.

The beneficial effects of the present invention are: the liquid injection method of the cartridge, the cartridge and the electronic cigarette provided by the present invention, after the liquid injection needle is pulled out, the pierced position on the sealing member can be automatically restored to seal the liquid storage cavity again, to prevent the e-liquid in the liquid storage cavity from leaking after the liquid injection is completed. In addition, after the injection is completed, the first blind hole and the second blind hole are blocked by the first electrode and the second electrode, respectively, thus further to prevent the e-liquid from leaking.

Figure 1:
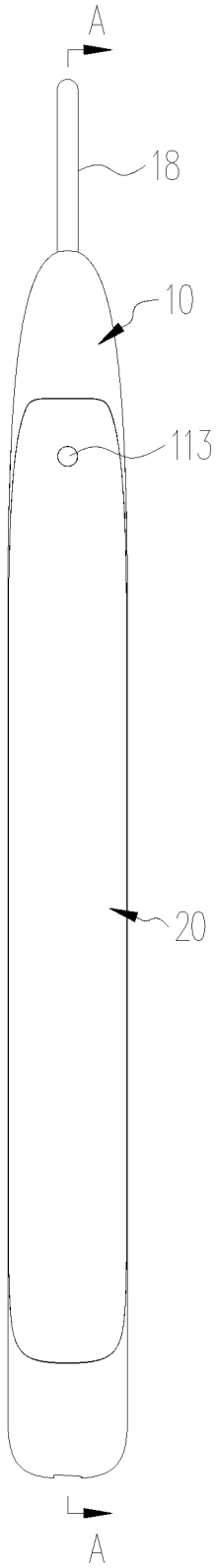
FIG. 1 is a front view of an electronic cigarette according to the first embodiment of the present disclosure.

| | | |
|---|---|---|
| cartridge 10 | liquid storage cavity 110 | cartridge housing 11 |
| vent tube 111 | engaging protrusion 113 | sealing member 12 |
| first blind hole 121 | second blind hole 122 | through hole 123 |
| first electrode 13 | second electrode 14 | atomizing head 15 |
| atomizing tube 151 | heating structure 152 | atomizing chamber 150 |
| pin 1523 | liquid guiding member 1521 | heating member 1522 |
| liquid inlet 1511 | fixed sleeve 153 | communication hole 1531 |
| base 16 | first mounting groove 161 | second mounting groove 162 |
| induction hole 163 | casing 17 | connecting portion 171 |
| lifting rod 18 | power supply device 20 | battery housing 21 |
| partition 211 | battery mounting groove 212 | cartridge mounting groove 213 |
| engaging groove 2131 | gap 2111 | first pole 2112 |

-continued

| | | |
|---|---|---|
| second pole 2113 | mounting column 2114 | sensing passage 2115 |
| battery 22 | sensor 23 | |

DETAILED DESCRIPTION OF PREFERRED EMBODIMENTS

The First Embodiment

Figure 2:
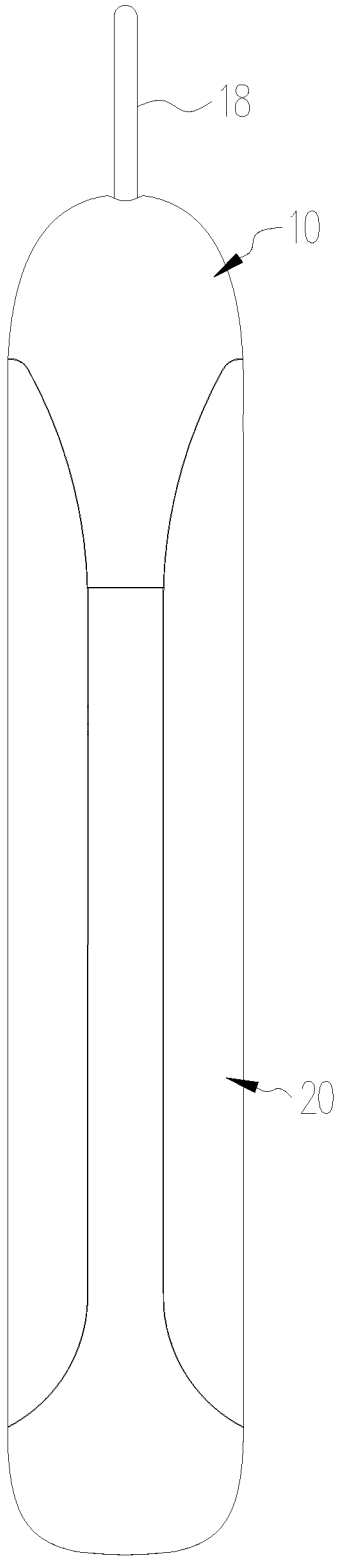
FIG. 2 is a left side view of the electronic cigarette shown in FIG. 1.

Referring to FIG. 1 and FIG. 2, the first embodiment of the present disclosure provides an electronic cigarette. The electronic cigarette includes a cigarette cartridge 10 and a power supply device 20 electrically connected to the cigarette cartridge 10. During operation, the power supply device 20 supplies power to the cartridge 10, so that the e-liquid stored in the cartridge 10 is atomized to generate smoke, and the smoke can be consumed by the user.

Figure 3:
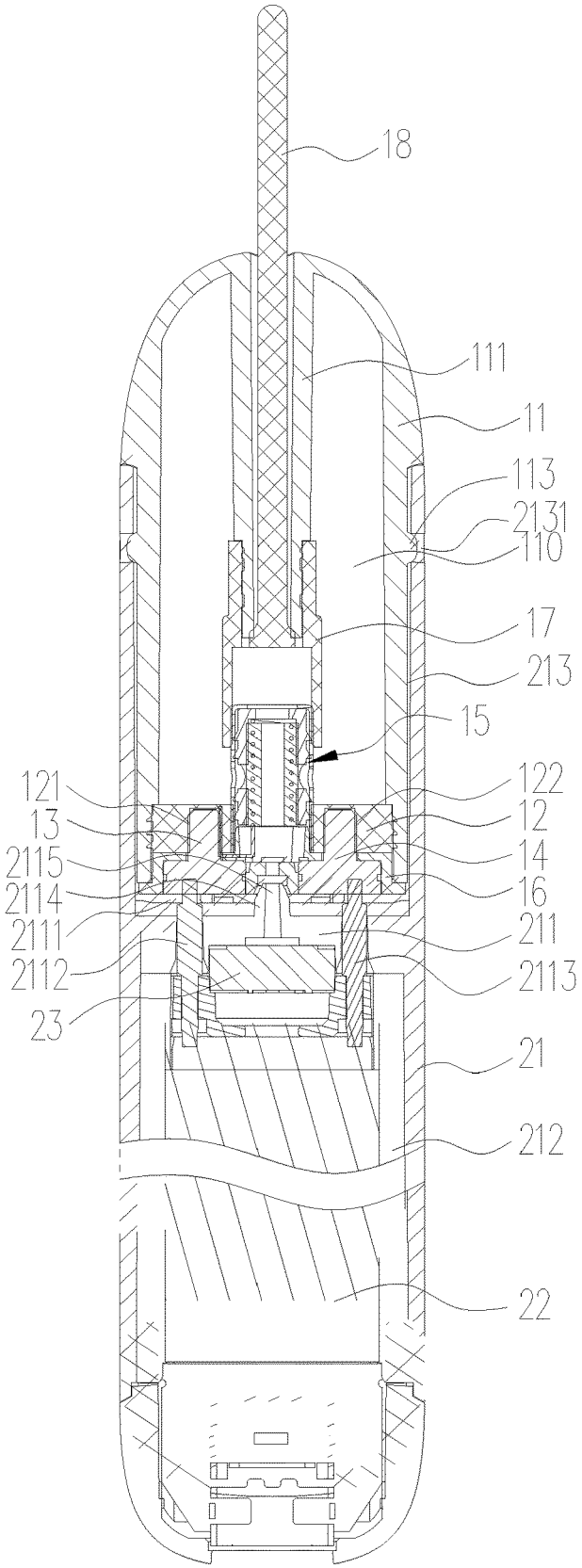
FIG. 3 is a cross-sectional view along A-A of the electronic cigarette shown in FIG. 1.
Figure 4:
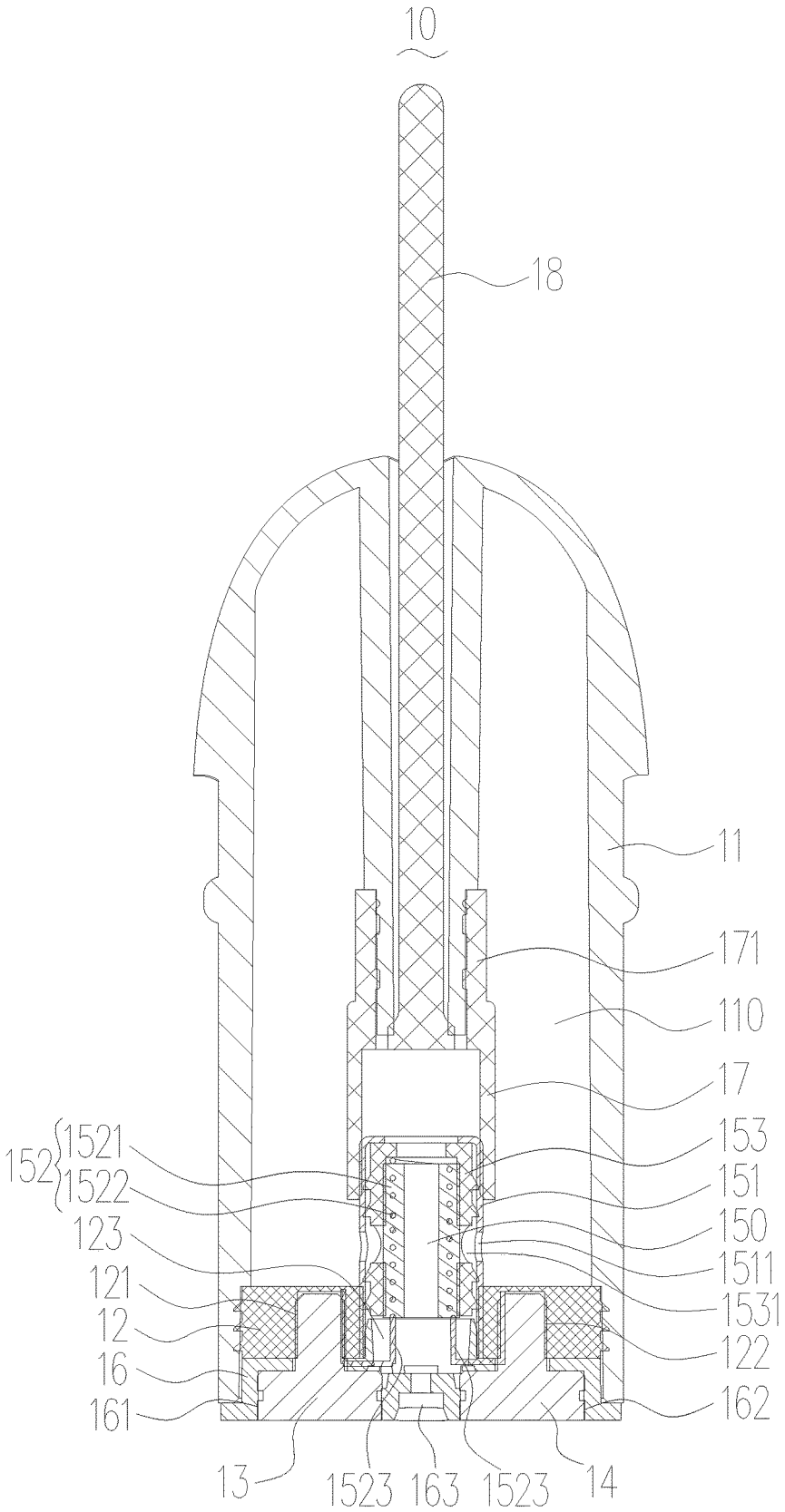
FIG. 4 is an enlarged view of the cartridge in the electronic cigarette shown in FIG. 3.

Please refer to FIGS. 3 and 4, the cartridge 10 includes a cartridge housing 11 having a liquid storage cavity 110, and a sealing member 12 for sealing the liquid storage cavity 110, and a first electrode 13 and a second electrode 14 mounted on the sealing member 12. A first blind hole 121 for installing the first electrode 13 and a second blind hole 122 for installing the second electrode 14 are respectively opened on the end face of the sealing member 12 away from the liquid storage cavity 110. The sealing member 12 is made of elastic material. After piercing the sealing member 12 through the wall of at least one of the first blind hole 121 and the second blind hole 122, the liquid injection needle communicates with the liquid storage cavity 110 to inject liquid into the liquid storage cavity 110. After the liquid injection is completed, the liquid injection needle is pulled out, and the sealing member 12 forms a self-sealing at the pierced position; then the first blind hole 121 is blocked by the first electrode 13, and the second blind hole 122 is blocked by the second electrode 14.

The cartridge 10 of the present invention, the sealing member 12 can be pierced by the liquid injection needle to facilitate the injection of e-liquid into the liquid storage cavity 110 through the liquid injection needle. And after the liquid injection needle is pulled out, the pierced position on the sealing member 12 can be automatically restored to seal the liquid storage cavity 110 again to prevent the e-liquid in the liquid storage cavity 110 from leaking after the liquid injection is completed. In addition, after the injection is completed, the first blind hole 121 and the second blind hole 122 are blocked by the first electrode 13 and the second electrode 14, respectively. Thus, even if the e-liquid in the liquid storage cavity 110 leaks through the pierced position, the leaked e-liquid can be sealed by the first electrode 13 and/or the second electrode 14, which can further prevent the leakage of the e-liquid, and avoids the corrosion of the power supply device 20 due to the leakage of the e-liquid.

In a specific embodiment, the sealing member 12 can be made of a soft material with elastic deformation ability, and can be a highly elastic polymer, for example, rubber or silicone. It is understood that, in other embodiments, the sealing member 12 can also be made of a self-healing material. Therefore, the sealing member 12 can be pierced by a sharp object (for example, a liquid injection needle); and after the sharp object is pulled out, it can be automatically restored and sealed again. The sealing member 12 is to seal the liquid storage cavity 110 to prevent the e-liquid in the liquid storage cavity 110 from leaking during transportation, storage or use. Further, after the cartridge 10 is assembled, the liquid injection needle pierces the sealing member 12 and injects e-liquid into the liquid storage cavity 110; after the liquid injection needle is pulled out, the sealing member 12 automatically recovers, and the liquid storage cavity 110 is sealed again.

In addition, the arrangement of the first blind hole 121 and the second blind hole 122, on the one hand, can be used for the installation of the first electrode 13 and the second electrode 14 respectively. On the other hand, the blind hole reduces the thickness of the sealing member 12 at the pierced position, so that the liquid injection needle can pierce the sealing member 12 more easily. The remaining part of the sealing member 12 still retains a relatively large thickness, which makes the sealing connection between the sealing member 12 and the cartridge housing 11 more stable, and prevents the e-liquid in the liquid storage cavity 110 from leaking through the connection between the sealing member 12 and the cartridge housing 11.

In a specific embodiment, during liquid injection, the liquid injection needle pierces the sealing member 12 through the bottom wall of the first blind hole 121 and then communicates with the liquid storage cavity 110 for liquid injection operation. In order to ensure the balance of the air pressure in the liquid storage cavity 110, that is, to ensure that the air in the liquid storage cavity 110 is automatically discharged during the liquid injection operation, an incision is provided on the wall of the second blind hole 122, the incision can be self-sealed when it is not filled with liquid. In the liquid injection state, the pressure in the liquid storage cavity 110 increases, the incision can be opened under the pressure, and the air in the liquid storage cavity 110 can be discharged through the ejected incision. It is understood that, in other embodiments, the liquid injection needle pierces the sealing member 12 through the wall of the second blind hole 122 to achieve liquid injection. Or, there are two liquid injection needles, and the two liquid injection needles pierce the sealing member 12 through the wall of the first blind hole 121 and the wall of the second blind hole 122 at the same time to achieve liquid injection. At this time, in order to discharge the air in the liquid storage cavity 110, a through hole communicating with the liquid storage cavity 110 is opened at one end of the cartridge housing 11 opposite to the sealing member 12, the air in the liquid storage cavity 110 is discharged from the through hole during liquid injection. In addition, the liquid injection needle can also pierce the sealing member 12 through the side wall of the first blind hole 121 and/or the second blind hole 122 to achieve liquid injection, the pierced position of the liquid injection needle in the blind hole is not limited. It should be noted that, in order to prevent the e-liquid in the liquid storage cavity 110 from leaking from the exhaust end of the cartridge 10, during the filling process, it is only necessary to adjust the exhaust end of the cartridge 10 to the state above the cartridge 10.

Please refer to FIGS. 3 and 4 again, the cartridge 10 further includes an atomizing head 15 housed in the liquid storage cavity 110, the atomizing head 15 includes an atomizing tube 151 having an atomizing chamber 150 and a heating structure 152 contained in the atomizing chamber 150, the atomizing tube 151 is connected to the sealing member 12, the heating structure 152 has the ability to absorb e-liquid, and can generate heat after being energized. The heating structure 152 has two pins 1523 extending to the outside of the liquid storage cavity 110. The ends of the two pins 1523 protruding to the outside of the liquid storage cavity 110 are both bent and arranged, the bent end of one of the pins 1523 extends into the first blind hole 121 and is squeezed and fixed on the side wall of the first blind hole 121 by the first electrode 13; the bent end of the other pin 1523 extends into the second blind hole 122 and is squeezed and fixed on the side wall of the second blind hole 122 by the second electrode 14. Therefore, while the function of electrically connecting the two pins 1523 of the heating structure 152 with the first electrode 13 and the second electrode 14 is realized, the fixing function of the heating structure 152 is also realized. In addition, when the user needs to disassemble or replace the heating structure 152, he only needs to remove the first electrode 13 and the second electrode 14, so as to release the pin 1523 from squeezing; the heating structure 152 can be easily removed, the operation is simple and convenient, and the user experience is improved. In addition, the two pins 1523 of the heating structure 152 are not immersed in the liquid storage cavity 110, which prevents the pins 1523 from being corroded by the e-liquid.

In this embodiment, the heating structure 152 is a ceramic heating body, that is, while the ceramic heating body has the ability to absorb the e-liquid, it also has the ability to heat the e-liquid. Itis understood that, in other embodiments, the heating structure 152 includes a liquid guiding member 1521 and a heating member 1522 that are in contact with each other. The liquid guiding member 1521 is a member capable of absorbing e-liquid, such as cotton, sponge, fiber rope, porous ceramic or porous graphite, etc. The heating member 133 is an member that has the ability to heat the e-liquid after being energized, such as a heating plate, a heating net, or a heating rod. It is understood that, the heating structure 152 may also be an ultrasonic heating device or a heating tube, etc., which is not limited here.

In a specific embodiment, the cartridge housing 11 is generally a hollow cylindrical structure with an opening at the lower end, the cartridge housing 11 has a flat structure, which serves as the contour of the cartridge 10, which can effectively prevent the cartridge 10 from rolling and avoid the cartridge 10 from falling. The liquid storage cavity 110 is constituted by the inner cavity of the cartridge housing 11, and the e-liquid is stored in the liquid storage cavity 110. The sealing member 12 seals the lower end opening of the cartridge housing 11. The cartridge housing 11 is made of a transparent or translucent material, so that the user can observe the amount of e-liquid in the liquid storage cavity 110 through the cartridge housing 11, which is convenient for the user to inject the liquid in time. In this embodiment, the cartridge housing 11 is made of translucent plastic.

In addition, the center of the upper end surface of the cartridge housing 11 extends downward along the axial direction of the cartridge housing 11 to form a vent tube 111, the upper and lower ends of the vent tube 111 are passing therethrough, the upper end of the vent tube 111 passes through the upper end surface of the cartridge housing 11 to form a smoke outlet. The sealing member 12 is located at the other end of the cartridge housing 11 relative to the smoke outlet. In addition, the lower end of the vent tube 111 is in communication with the atomizing chamber 150, so that the smoke in the atomizing chamber 150 enters the user's mouth through the vent tube 111.

The sealing member 12 is generally a block structure, the sealing member 12 is received in the lower end of the cartridge housing 11 to close the liquid storage cavity 110. Specifically, the liquid storage cavity 110 is constituted by a space enclosed between the inner wall of the cartridge housing 11, the outer wall of the vent tube 111 and the upper end surface of the sealing member 12. A through hole 123 is opened in the center of the sealing member 12 along the axial direction of the sealing member 12, the through hole 123 passes through the upper and lower end faces of the sealing member 12. The atomizing tube 151 is in communication with the through hole 123. The two pins 1523 of the heating structure 152 pass through the through hole 123 and then extend to the outside of the liquid storage cavity 110. In addition, the first blind hole 121 and the second blind hole 122 are arranged on the lower end surface of the sealing member 12 and symmetrically arranged on both sides of the through hole 123. That is, the first blind hole 121 and the second blind hole 122 are symmetrically arranged with respect to the central axis of the cartridge housing 11.

The atomizing tube 151 is generally a hollow cylindrical structure with both ends passing through, the atomizing chamber 150 is formed by the inner cavity of the atomizing tube 151, the lower end of the atomizing tube 151 is sealed and inserted into the through hole 123, the upper end of the atomizing tube 151 is received in the liquid storage cavity 110, the side wall of the atomizing tube 151 is provided with a liquid inlet 1511, the liquid inlet 1511 is in communication with the liquid storage cavity 110 and the atomizing chamber 150. In use, the e-liquid in the liquid storage cavity 110 enters the atomizing chamber 150 through the liquid inlet 1511 to contact the heating structure 152, and then generates smoke under the heating action of the heating structure 152.

In addition, the atomizing head 15 further includes a fixing sleeve 153, the fixing sleeve 153 is sandwiched between the inner circumferential surface of the atomizing tube 151 and the outer circumferential surface of the heating structure 152, the fixing sleeve 153 is made of high temperature resistant silicone or rubber material. By providing the fixing sleeve 153, the connection stability between the heating structure 152 and the atomizing tube 151 is increased, and the heating structure 152 and the atomizing tube 151 are prevented from being separated. At the same time, the side wall of the fixing sleeve 153 is provided with a communication hole 1531, the communication hole 1531 is in communication with the liquid inlet 1511 and the heating structure 152; therefore, the e-liquid in the liquid storage cavity 110 sequentially passes through the liquid inlet 1511 and the communication hole 1531 and then contacts the heating structure 152.

In a specific embodiment, the cartridge 10 further includes a base 16, the base 16 is covered on the lower end of the cartridge housing 11 and is located outside the liquid storage cavity 110, the upper end surface of the base 16 resists the lower end surface of the sealing member 12, thereby supporting the sealing member 12 made of elastic material and preventing the sealing member 12 from easily deforming and affecting the sealing effect of the e-liquid. In addition, the base 16 and the cartridge housing 11 can be connected by screw connection, snapping connection, plugging connection, or magnetic connection, which is not limited here.

Referring to FIG. 4, in a specific embodiment, the lower end surface of the base 16 is recessed to form a first mounting groove 161 and a second mounting groove 162, the first mounting groove 161 corresponds to the first blind hole 121, and the size of the first mounting groove 161 is larger than the size of the first blind hole 121. The second mounting groove 162 corresponds to the second blind hole 122, and the size of the second mounting groove 162 is larger than the size of the second blind hole 122. Both the first electrode 13 and the second electrode 14 have a trapezoidal structure, the upper end of the first electrode 13 passes through the bottom wall of the first mounting groove 161 and then is tightly inserted into the first blind hole 121, the lower end of the first electrode 13 is received in the first mounting groove 161 and resists the bottom wall of the first mounting groove 161, the upper end of the second electrode 14 passes through the bottom wall of the second mounting groove 162 and then is tightly inserted into the second blind hole 122, the lower end of the second electrode 14 is received in the second mounting groove 161 and resists the bottom wall of the second mounting groove 162. Therefore, the insertion depth of the first electrode 13 in the first blind hole 121 and the insertion depth of the second electrode 14 in the second blind hole 122 are limited, and the insertion depth of the first electrode 13 and the second electrode 14 is avoided. The pierced position opens, which leads to the leakage of e-liquid. It should be noted that after the first electrode 13 and the second electrode 14 are installed in place, the lower end surface of the first electrode 13 and the lower end surface of the second electrode 14 are flush with the lower end surface of the base 16, making the cartridge 10 more beautiful. It is understood that, in other embodiments, both the first mounting groove 162 and the second mounting groove 162 may also be omitted, the upper end of the first electrode 13 passes through the base 16 and is tightly inserted into the first blind hole 121 to block the first blind hole 121, the lower end of the first electrode 13 is located outside the base 16 and resists the lower end surface of the base 16, and the upper end of the second electrode 14 passes through the base 16 and is tightly inserted into the second blind hole 122 to block the second blind hole 122, the lower end of the second electrode 14 is located outside the base 16 and resists the lower end surface of the base 16. In addition, to achieve electrical isolation and avoid short circuits, the base 16 is made of an insulating hard material. In this embodiment, the base 16 is made of plastic.

In addition, the lower end surface of the base 16 is provided with an induction hole 163 communicating with the atomizing chamber 150 along the axial direction of the base 16. There is one induction hole 163 and is located at the center of the base 16, the first mounting groove 161 and the second mounting groove 162 are symmetrically arranged on both sides of the induction hole 163. In a specific embodiment, the lower end surface of the base 16 is also provided with an air inlet communicating with the atomizing chamber 150, the air inlet hole is located on one side of the induction hole 163.

It is understood that, in other embodiments not shown, the base 16 can also be omitted, the first electrode 13 is completely inserted into the first blind hole 121, the second electrode 15 is completely inserted into the second blind hole 122. Thus, it is only necessary that the first electrode 14 is at least partially tightly inserted into the first blind hole 121 and the inserted part blocks the first blind hole 121, and the atomizing head 14 is at least partially tightly inserted into the second blind hole 122 and the inserted part blocks the second blind hole 122.

In a specific embodiment, the cartridge 10 further includes a partition component, the separating assembly includes a casing 17 and a lifting rod 18, the casing 17 has a hollow cylindrical structure with an opening at the lower end, the casing 17 is slidably sleeved on the outside of the atomizing tube 151 along the axial direction of the atomizing head 15, and the lifting rod 18 has a rod-shaped structure and slidably penetrates the inside of the vent tube 111, the lower end of the lifting rod 18 is connected with the upper end of the casing 17, the upper end of the lifting rod 18 passes through the upper end opening of the vent tube 111 and then extends to the outside of the cartridge housing 11. When the cartridge 10 is shipped from the factory, the casing 17 corresponding to the liquid inlet 1511 is sleeved on the outside of the atomizing tube 151 to close the liquid inlet 1511, to prevent the e-liquid in the liquid storage cavity 110 from entering the atomizing head 15 through the liquid inlet 1511, thereby isolating the e-liquid from the outside air, which can prevent the e-liquid from entering the atomizing head 15 and contacting the air due to changes in temperature and air pressure during the transportation process, and it can also further prevent the e-liquid leaking due to too much e-liquid entering the atomizing head 15. In use, the lifting rod 18 is lifted upwards, the casing 17 is driven by the lifting rod 18 to move upward together to open the liquid inlet 1511, so that the e-liquid communicates with the atomizing chamber 150 through the liquid inlet 1511. When the pulling rod 18 continues to be pulled upward until the upper end surface of the casing 17 resists the lower end surface of the vent tube 111, the lifting rod 18 can be separated from the casing 17, and then can be withdrawn from the vent tube 111, and the vent tube 111 is opened; at this time, the atomizing chamber 150 is in communication with the inner cavity of the vent tube 111 through the casing 17.

It is understood that, the casing 17 is made of silicone or rubber material to facilitate the sealing effect of the cartridge 10 on the liquid inlet 1511 when it leaves the factory, and to facilitate the deformation of the casing 17 to separate it from the lifting rod 18. In this embodiment, the casing 17 and the lifting rod 18 are integrally formed, and the connection part between the casing 17 and the lifting rod 18 is pulled off and separated from the lifting rod 18.

In addition, the upper end surface of the casing 17 extends upward along the axial direction of the casing 17 to form a connecting portion 171, the connecting portion 171 is sleeved on the vent tube 111 so that the casing 17 is connected to the vent tube 111, which can prevent the e-liquid from leaking through the gap between the casing 17 and the vent tube 111, and play a guiding role during the movement of the casing 17.

Please refer to FIG. 3, the power supply device 20 includes a battery housing 21 and a battery 22 and a sensor 23 mounted on the battery housing 21.

In a specific embodiment, the battery housing 21 is generally a hollow cylindrical structure with an opening at the upper end, a partition 211 is provided inside the battery housing 21 along the radial direction of the battery housing 21, the partition 211 divides the inner cavity of the battery housing 21 into a battery mounting groove 212 for installing the battery 22 and a cartridge mounting groove 213 for installing the cartridge 10, the battery mounting groove 212 is located at one end of the battery housing 21 away from the opening. The cartridge 10 is connected to the battery housing 21 through the opening of the battery housing 21, specifically, two opposite sides of the cartridge housing 11 are provided with engaging protrusions 113, the wall of the cartridge mounting groove 213 is provided with an engaging groove 2131 corresponding to the engaging protrusion 113; when the cartridge 10 is inserted into the battery housing 21, the engaging protrusion 113 is matched with the engaging groove 2131 to stabilize the connection between the cartridge 10 and the power supply device 20.

In addition, when the cartridge 10 and the power supply device 20 are installed in place, a gap 2111 is formed between the lower end surface of the base 16 and the upper end surface of the partition 211. The gap 2111 is in communication with the air inlet and the outside atmosphere, so that external air can easily enter the inside of the cartridge 10.

A first pole 2112 and a second pole 2113 are respectively installed on the partition 211, the first pole 2112 is electrically connected to one of the positive and negative electrodes of the battery 22, the second pole 2113 is electrically connected to the other of the positive and negative electrodes of the battery 22. When the cartridge 10 and the power supply device 20 are installed in place, the first pole 2112 is in contact with the first electrode 13 and is electrically connected, the second pole 2113 is in contact with the second electrode 14 and is electrically connected, thereby realizing the function of the battery 22 to supply power to the heating structure 152.

In addition, a mounting column 2114 is protrudes from the upper end surface of the partition 211 corresponding to the induction hole 163, the mounting column 2114 is provided with a sensing passage 2115, the upper end of the sensing passage 2115 penetrates the upper end surface of the mounting column 2114, the lower end of the sensing passage 2115 penetrates the lower end surface of the partition 211. The first pole 2112 and the second pole 2113 are symmetrically arranged on both sides of the mounting column 2114, that is, the first pole 2112 and the second pole 2113 are symmetrically arranged with respect to the central axis of the cartridge housing 11. In this way, when the cartridge 10 is installed on the power supply device 20, there is no need to consider the positive and negative polarity, and the effect that both positive and negative plugs can be used is achieved. Specifically, when the cartridge 10 and the power supply device 20 are in the first connection state, the first pole 2112 is in contact with the first electrode 13 and is electrically connected. When the cartridge 10 and the power supply device 20 are in the second connection state, the first pole 2113 contacts the second electrode 14 and is electrically connected. In this embodiment, the transition from the first connection state to the second connection state is obtained by rotating the power supply device 20 relative to the cartridge 10 by 180°, so as to achieve the purpose of electrical conduction for both positive and negative insertion. The sensor 23 is installed at the lower end of the partition 211 and closes the sensing passage 2115, the sensing end of the sensor 23 is connected to the sensing passage 2115. When the cartridge 10 and the power supply device 20 are installed in place, the mounting column 2114 is partially inserted into the base 16, and the sensing passage 2115 is connected to the induction hole 163.

In a specific embodiment, the power supply device 20 further includes a circuit board, both the battery 22 and the sensor 23 are electrically connected to the circuit board, the sensor 23 is a pressure sensor. When the user inhales, a negative pressure is generated in the sensing passage 2115 due to the suction effect, the sensor 23 senses the air pressure change in the sensing passage 2115 and transmits the air pressure change signal to the circuit board; after receiving the signal, the circuit board controls the battery 22 to supply power to the heating structure 152, thereby heating the e-liquid, so that the e-liquid generates smoke under the heating action, and realizes automatic control. It is understood that the sensor 23 may also be an airflow sensor.

In the cartridge 10 provided by the present invention, the sealing member 12 can be pierced by the liquid injection needle to facilitate the injection of e-liquid into the liquid storage cavity 110 through the liquid injection needle, and after the liquid injection needle is pulled out, the pierced position on the sealing member 12 can be automatically restored to seal the liquid storage cavity 110 again, preventing the e-liquid in the liquid storage cavity 110 from leaking after the liquid injection is completed. In addition, after the injection is completed, the first blind hole 121 and the second blind hole 122 are blocked by the first electrode 13 and the second electrode 14, respectively. In this way, even if the e-liquid in the liquid storage cavity 110 leaks through the pierced position, the leaked e-liquid can be sealed by the first electrode 13 and/or the second electrode 14 to further prevent the e-liquid from leaking.

The present disclosure provides the electronic cigarette of the first embodiment. Because it has all the technical features of the above-mentioned cartridge 10, it has the same technical effect as the above-mentioned cartridge 10.

The Second Embodiment

In the second embodiment of the present invention, a liquid injection method of a cartridge is also disclosed, which is used to inject liquid into the cartridge of an electronic cigarette. In a specific embodiment, the cartridge is the cartridge 10 in the first embodiment, the cartridge 10 includes a cartridge housing 11 with a liquid storage cavity 110, a sealing member 12 for sealing the liquid storage cavity 110, and a first electrode 13 and a second electrode 14. A first blind hole 121 for installing the first electrode 13 and a second blind hole 122 for installing the second electrode 14 are respectively opened on the end face of the sealing member 12 away from the liquid storage cavity 110. The sealing member 12 is made of elastic material. The injection method includes:

Step 1: After the liquid injection needle pierces the sealing member 12 through the wall of at least one of the first blind hole 121 and the second blind hole 122, and then communicates with the liquid storage cavity 110 to inject liquid into the liquid storage cavity 110;

Step 2: After the liquid injection is completed, pull out the liquid injection needle, and the sealing member 12 forms a self-sealing at the pierced position;

Step 3: The first blind hole 121 is blocked by the first electrode 13, and the second blind hole 122 is blocked by the second electrode 14.

In addition, an incision is provided on the wall of the second blind hole 122, during the liquid injection process, the pressure in the liquid storage cavity 110 increases so that the incision is pushed open, the air in the liquid storage cavity 110 is discharged from the cutout.

In the liquid injection method of the cartridge of the second embodiment of the present invention, after the liquid injection needle is pulled out, the pierced position on the sealing member 12 can be automatically restored to seal the liquid storage cavity 110 again, to prevent the e-liquid in the liquid storage cavity 110 from leaking after the liquid injection is completed. In addition, after the injection is completed, the first blind hole 121 and the second blind hole 122 are blocked by the first electrode 13 and the second electrode 14, respectively. In this way, even if the e-liquid in the liquid storage cavity 110 leaks through the pierced position, the leaked e-liquid can be sealed by the first electrode 13 and/or the second electrode 14 to further prevent the e-liquid from leaking.

What is claimed is:

1. A cartridge comprising:

a cartridge housing that defines a vent tube and encloses a liquid storage cavity;

a sealing member made of an elastic material and is disposed at one end of the cartridge housing, forming a seal for the liquid storage cavity;

a first blind hole and a second blind hole formed on one end face of the sealing member away from the liquid storage cavity;

a first electrode and a second electrode mounted on the sealing member by insertion into the first blind hole and the second blind hole, respectively;

an atomizing head disposed in the cartridge housing in alignment with the vent tube, wherein the atomizing head comprises an atomizing tube housing an atomizing cavity and a heating structure, and the atomizing tube comprises a liquid inlet on a wall thereof; and a separating assembly comprising a casing connected to a lifting rod, wherein the lifting rod extends through the vent tube and the casing sleeves over a portion of the vent tube and a portion of the atomizing head, when the lifting rod is in a first state, the casing blocks the liquid inlet in the atomizing tube, when the lifting rod is lifted to a second state, the casing is lifted with the lifting rod to expose the liquid inlet to the liquid storage cavity such that a liquid in the liquid storage cavity enters the atomizing tube through the liquid inlet, wherein the lifting rod is separable from the casing and withdrawn from the vent tube.

2. The cartridge according to claim 1, wherein the heating structure has a first pin in contact with the first electrode and a second pin in contact with the second electrode.

3. The cartridge according to claim 2, wherein the sealing member is provided with a through hole, one end of the atomizing tube is inserted into the through hole.

4. The cartridge according to claim 1, wherein the atomizing head further comprises a base, the base is located outside the liquid storage cavity and resists the end surface of the sealing member away from the liquid storage cavity.

5. The cartridge according to claim 4, wherein the base is provided with a first mounting groove corresponding to the first blind hole and a second mounting groove corresponding to the second blind hole, one end of the first electrode passes through the bottom wall of the first mounting groove and is inserted into the first blind hole, the other end of the first electrode is against the bottom wall of the first mounting groove; and one end of the second electrode passes through the bottom wall of the second mounting groove and is inserted into the second blind hole, the other end of the second electrode abuts against the bottom wall of the second mounting groove.

6. The cartridge according to claim 1, wherein one end of the vent tube serves as a smoke outlet that opens at one end of the cartridge housing, the sealing member is located at the other end of the cartridge housing relative to the smoke outlet, the first electrode and the second electrode are symmetrically arranged with respect to the central axis of the cartridge housing.

7. An electronic cigarette comprising the cartridge according to claim 1.

8. The electronic cigarette according to claim 7, wherein the cartridge further comprises a power supply device comprising a battery housing and a battery, the battery housing has an opening, and a partition is arranged in the battery housing, the partition divides the inner cavity of the battery housing into a battery mounting groove for installing the battery and a cartridge mounting groove for installing a cigarette cartridge, and the battery mounting groove is located at an end of the battery housing away from the opening.

9. The electronic cigarette according to claim 8, wherein a first pole and a second pole are respectively installed on the partition, the first pole and the second pole are respectively is electrically connected to one of two electrodes of the battery, when the cartridge and the power supply device are in the first connection state, the first pole is in contact with the first electrode and is electrically connected; and when the cartridge and the power supply device are in the second connection state, the second pole is in contact with the second electrode and is electrically connected.

10. A liquid injection method for the cartridge according to claim 1, the liquid injection method comprises the following steps:

step 1: piercing at least one of the first blind hole and the second blind hole in the cartridge with a liquid injection needle, and injecting a liquid in the liquid injection needle into the liquid storage cavity; and step 2: pulling out the liquid injection needle from the sealing member.

11. The liquid injection method according to claim 10, wherein an incision is provided on the wall of the second blind hole, during the liquid injection process, the pressure in the liquid storage cavity increases so that the incision is pushed open, the air in the liquid storage cavity is discharged from the cutout.

* * * * *